US007411441B2

(12) United States Patent
Rashid

(10) Patent No.: US 7,411,441 B2
(45) Date of Patent: Aug. 12, 2008

(54) BIAS CIRCUITRY

(75) Inventor: Tahir Rashid, Maidenhead (GB)

(73) Assignee: STMicroelectronics Limited, Marlow, Buckinghamshire ( * ) Notice: Subject to any disclaimer, the term of this patent is extended or adjusted under 35 U.S.C. 154(b) by 193 days.

(21) Appl. No.: 10/896,371

(22) Filed: Jul. 21, 2004

(65) Prior Publication Data

US 2005/0068091 A1 Mar. 31, 2005

(30) Foreign Application Priority Data

Jul. 22, 2003 (EP) ..... 03254577

(51) Int. Cl.
*G05F 1/10* (2006.01)

(52) U.S. Cl. ..... 327/538; 323/312

(58) Field of Classification Search ..... 327/538, 327/539, 540, 541, 543; 323/312, 315
See application file for complete search history.

(56) References Cited

U.S. PATENT DOCUMENTS

| | | | | |
|---|---|---|---|---|
| 4,740,742 | A * | 4/1988 | Gontowski, Jr. | 323/313 |
| 4,808,908 | A * | 2/1989 | Lewis et al. | 323/313 |
| 4,990,864 | A | 2/1991 | Kwan | |
| 5,001,414 | A * | 3/1991 | Brambilla et al. | 323/313 |
| 5,049,806 | A * | 9/1991 | Urakawa et al. | 323/314 |
| 5,278,491 | A * | 1/1994 | Nitta et al. | 323/313 |
| 5,352,973 | A * | 10/1994 | Audy | 323/313 |
| 5,774,013 | A * | 6/1998 | Groe | 327/543 |
| 5,801,582 | A * | 9/1998 | Weber | 327/539 |
| 5,959,477 | A | 9/1999 | Chung | |
| 5,969,566 | A * | 10/1999 | Weber et al. | 327/540 |
| 6,040,736 | A * | 3/2000 | Milanesi et al. | 327/541 |
| 6,175,224 | B1 | 1/2001 | Kadanka | |
| 6,294,902 | B1 * | 9/2001 | Moreland et al. | 323/268 |
| 6,323,630 | B1 * | 11/2001 | Banba | 323/313 |
| 6,356,064 | B1 * | 3/2002 | Tonda | 323/313 |
| 6,407,638 | B1 * | 6/2002 | Migliavacca | 330/289 |
| 6,426,669 | B1 | 7/2002 | Friedman et al. | |
| 6,600,302 | B2 * | 7/2003 | Ghozeil et al. | 323/313 |
| 6,600,304 | B2 * | 7/2003 | Kim | 323/315 |
| 6,982,590 | B2 * | 1/2006 | Seshita | 327/539 |
| 7,030,668 | B1 * | 4/2006 | Edwards | 327/143 |
| 2002/0063598 | A1 * | 5/2002 | Huijsing et al. | 330/257 |
| 2002/0190777 | A1 * | 12/2002 | Nishizono et al. | 327/345 |
| 2004/0119528 | A1 * | 6/2004 | Rashid | 327/538 |
| 2005/0035813 | A1 * | 2/2005 | Xi | 327/539 |
| 2005/0104652 | A1 * | 5/2005 | Seshita | 327/539 |

OTHER PUBLICATIONS

Hambley, Allan R., "Electrical Engineering Principles and Application". Second Edition. Pearson Education, Inc., 2002, pp. 585, 587, 597.*

* cited by examiner

*Primary Examiner*—N. Drew Richards
*Assistant Examiner*—Thomas J Hiltunen

(57) ABSTRACT

A biasing circuit comprising a first switching device having a control terminal, and first and second switching terminals. The first switching terminal being connected to a supply voltage, the second switching terminal being connected through a first resistive element to ground, and the control terminal being supplied by a reference voltage which is determined depending on the mode of operation of the circuit. The circuit further comprising a first branch connected between the control terminal and ground comprising a second resistive element in series with a second switching device. The second switching device forming part of a first current mirror having a second branch for effecting a generated bias value. During a normal mode of operation the reference voltage is dependant on the generated bias value, whereas during a standby mode of operation the reference voltage is connected to a low potential.

15 Claims, 2 Drawing Sheets

BIAS CIRCUITRY

FIELD OF THE INVENTION

The present invention relates to integrated circuitry and in particular, but not exclusively, to a bias circuit for biasing integrated circuitry.

BACKGROUND OF THE INVENTION

Typically, most integrated circuits are comprised of a multitude of transistors and the circuit typically comprises a number of stages, for example, an input stage, a emitter-follower stage, etc. The type of transistor used, for example FET (Field Effect Transistor), BJT (Bipolar Junction Transistor), etc., will often depend on the design considerations and the intended application of the integrated circuit.

Most active circuits would comprise a so-called biasing circuit, which is used to set the integrated circuit to operate at a desired quiescent operating point depending on the design requirements. For example, it might be required to bias a FET transistor to operate with a drain-source voltage (VDS) of 4 Volts and at 60% of the saturated drain current (IDSS).

The choice of bias circuit used is determined by, amongst other things: bias level, precision, stability, etc. There are many different ways to create such a bias circuit.

FIG. 1 shows a commonly used bias circuit known as a PTAT (Proportional To Absolute Temperature) generator. The circuit in FIG. 1 has first 100 and second 200 branches connected between supply VDD and ground GND rails. The first branch 100 comprises a first bipolar transistor Q1 with its base tied to its collector, a second bipolar transistor Q4 and a resistor R. The resistor R is connected to ground at one end and to the emitter of the second transistor Q4. The collector of the second transistor is connected to the collector of the first transistor Q1. The emitter of the first transistor is connected to the voltage supply VDD.

The second branch 200 includes a third bipolar transistor Q2 with its base connected to the base of the first bipolar transistor Q1 in the first branch, and a fourth bipolar transistor Q5 with its base connected to its collector and its base also connected to the base of the second bipolar transistor Q4 in the first branch. The emitter of the fourth transistor Q5 is connected to ground and the collector of the fourth transistor is connected to the collector of the third transistor Q2. The emitter of the third transistor is connected to the voltage supply. Thus, the first and third transistors (Q1, Q2) are connected in a current mirror configuration, as are the second and fourth transistors (Q4, Q5). An output transistor Q3 is located in a third branch 300 with its base connected to the bases of the first and third transistors Q1,Q2 and its emitter connected to the supply rail VDD. The output current Iout is the collector current of the output transistor Q3 which is supplied to the load driven by the output current. The emitter of the second bipolar transistor Q4 in the second branch is connected to the lower supply rail GND through the resistor R. The first, second and third branches are connected in parallel.

In this circuit assuming the area of the bipolar transistor Q4 is n times the area of the bipolar transistor Q5 then it can be shown that the output current $I_{OUT}$ is given by:

$$I_{OUT} = \frac{V_T \ln(n)}{R}$$

Where $V_T$ is the thermal voltage (KT/q) and ln(n) is the natural logarithm of n. Hence $I_{OUT}$ is proportional to the absolute temperature T.

However, the disadvantage of the biasing circuit of FIG. 1 becomes evident when the circuit is to be put into a so-called "standby" mode of operation. In standby mode, the bias circuitry is in effect bypassed and no bias values are produced. This would typically entail the use of a MOSFET switch (not shown), which is located between the bases of the second and fourth transistors Q4 and Q5 and ground GND. For example, a MOS transistor could be connected so that: its drain terminal is connected to the base terminal of the Q4 transistor, its source terminal is connected to the emitter terminal of Q5, and its gate terminal is connected to an IN terminal (not shown), which provides a signal for turning the MOS on or off.

However, the disadvantage of using a MOS device within a circuit of this type is that it the gate source breakdown voltage of MOS devices is considerably lower than that of bipolar devices and the required operating voltage of the integrated circuit. Therefore, a MOS switch cannot be adequately used when relatively high voltages are used.

It is an object of an embodiment of the present invention to have a bias circuit, which can operate in a standby mode at relatively high voltages without being susceptible to the aforementioned disadvantages.

SUMMARY OF THE INVENTION

To address the above-discussed deficiencies of the prior art, according to one aspect of the present invention, there is provided a biasing circuit comprising: first circuitry having an output for providing an input to second circuitry and an input of the first circuitry for receiving an output from said second circuitry, said output of said second circuitry being responsive to the said output of said first circuitry, said first circuitry being arranged to provide a reference for controlling the input to the second circuitry, said first circuitry being responsive to the output from said second circuitry when providing said reference.

Preferably, wherein a voltage is provided on a second input of the first circuitry when said first circuit provided said reference.

Preferably, wherein said second input is a control terminal for a switching device having first and second switching terminals, the first switching terminal being connected to a second voltage, the second switching terminal being connected through a first resistance to a third voltage.

Preferably, the first circuit comprising a first branch connected between the control terminal and the third voltage, the first branch having a second resistance and a second switching device and wherein the second switching device forming a first current mirror with a second branch providing the output to the input of the second circuit.

Preferably, wherein the second branch of the first circuit further comprising a third switching device which is combined with the second switching device in the first branch to form the first current mirror.

Preferably, wherein the second branch further comprising a fourth switching device which is combined with a fifth switching device (Q40) in a third branch (17) to form a second current mirror.

Preferably, wherein the fifth switching device having a first and a second switching terminal, and said first switching terminal is connected to the supply voltage and the other switching terminal supplies the output to the second circuitry.

Preferably, wherein said voltage supplied to the second input of the first circuit is ground.

According to another aspect of the present invention there is provided an integrated circuit comprising such a biasing circuit.

According to a further aspect of the present invention there is provided a method of biasing a circuit, the method comprising: providing an output from first circuitry to an input of second circuitry; receiving at an input of the first circuitry an output from said second circuitry, said output of said second circuitry being responsive to the output of said first circuitry, and providing a reference from said first circuitry for controlling the input to the second circuitry, said first circuitry being responsive to the output from said second circuitry when providing said reference.

According to yet a further aspect of the present invention there is provided a biasing circuit comprising a first switching device having a control terminal and first and second switching terminals, the first switching terminal being connected to a first voltage, the second switching terminal being connected through a first resistive element to a second voltage, wherein the circuit further comprising a first branch connected between the control terminal and the second voltage having a second resistive element and a second switching device; the second switching device forming part of a first current mirror with a second branch for effecting a generated bias value, and wherein the control terminal is supplied by a reference voltage which is determined depending on a mode of operation of the circuit such that during a normal mode the reference voltage is dependant on the generated bias value, whereas during a standby mode the reference voltage is taken to a third voltage.

Preferably, wherein a second circuit is connected to receive the generated bias value and in response produces an output used to determine the reference voltage of the self-biasing circuit.

Preferably, wherein a third circuit is connected to the control terminal, which takes the reference voltage to a third voltage thereby inducing the standby mode so that no bias value is generated.

For a better understanding of the present invention and to show how the same may be carried into effect, reference will now be made by way of example to the accompanying drawings.

Before undertaking the DETAILED DESCRIPTION OF THE INVENTION below, it may be advantageous to set forth definitions of certain words and phrases used throughout this patent document; the terms "include" and "comprise," as well as derivatives thereof, mean inclusion without limitation; the term "or," is inclusive, meaning and/or; and the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to our with, have, have a property of, or the like. It should be noted that the functionality associated with any particular apparatus or controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

Other features and advantages of the invention will become apparent in the following description of nonlimiting exemplary embodiments, with reference to the accompanying drawings, in which like reference numerals represent like parts, in which.

DETAILED DESCRIPTION OF THE INVENTION

Figure 1:
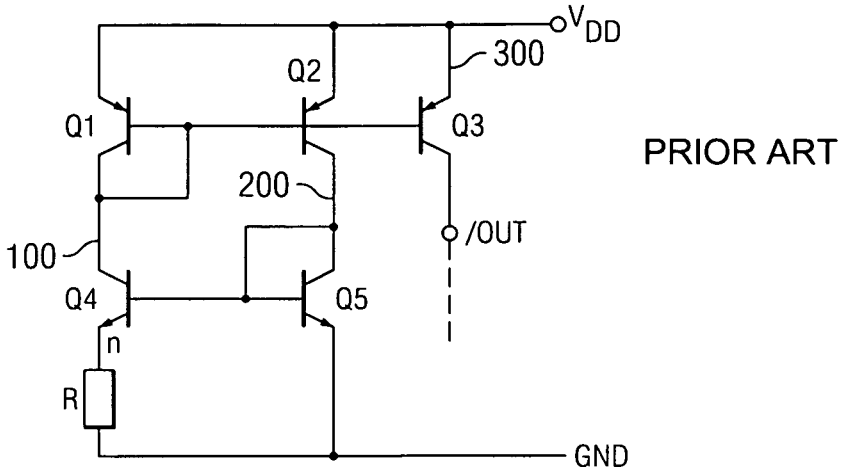
FIG. 1 shows a bias circuit known in the prior art.
Figure 2:
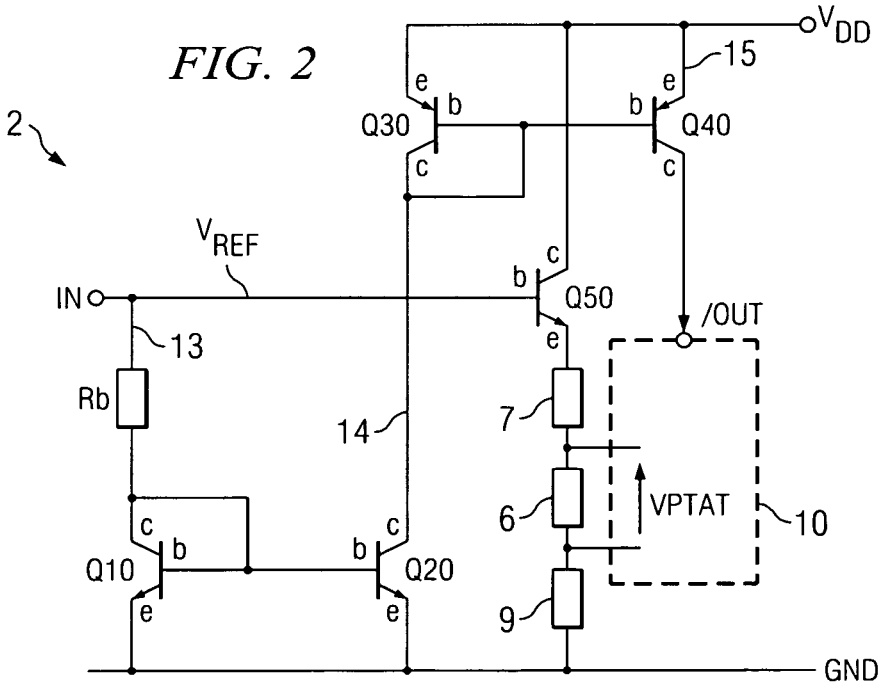
PRIOR ART FIG. 2
FIG. 2 shows a self-bias circuit according to one embodiment of the present invention.
Figure 3:
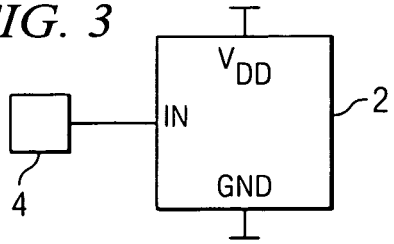
FIG. 3 shows a three-pin self-bias circuit and external circuitry according to an embodiment of the present invention.
Figure 4:
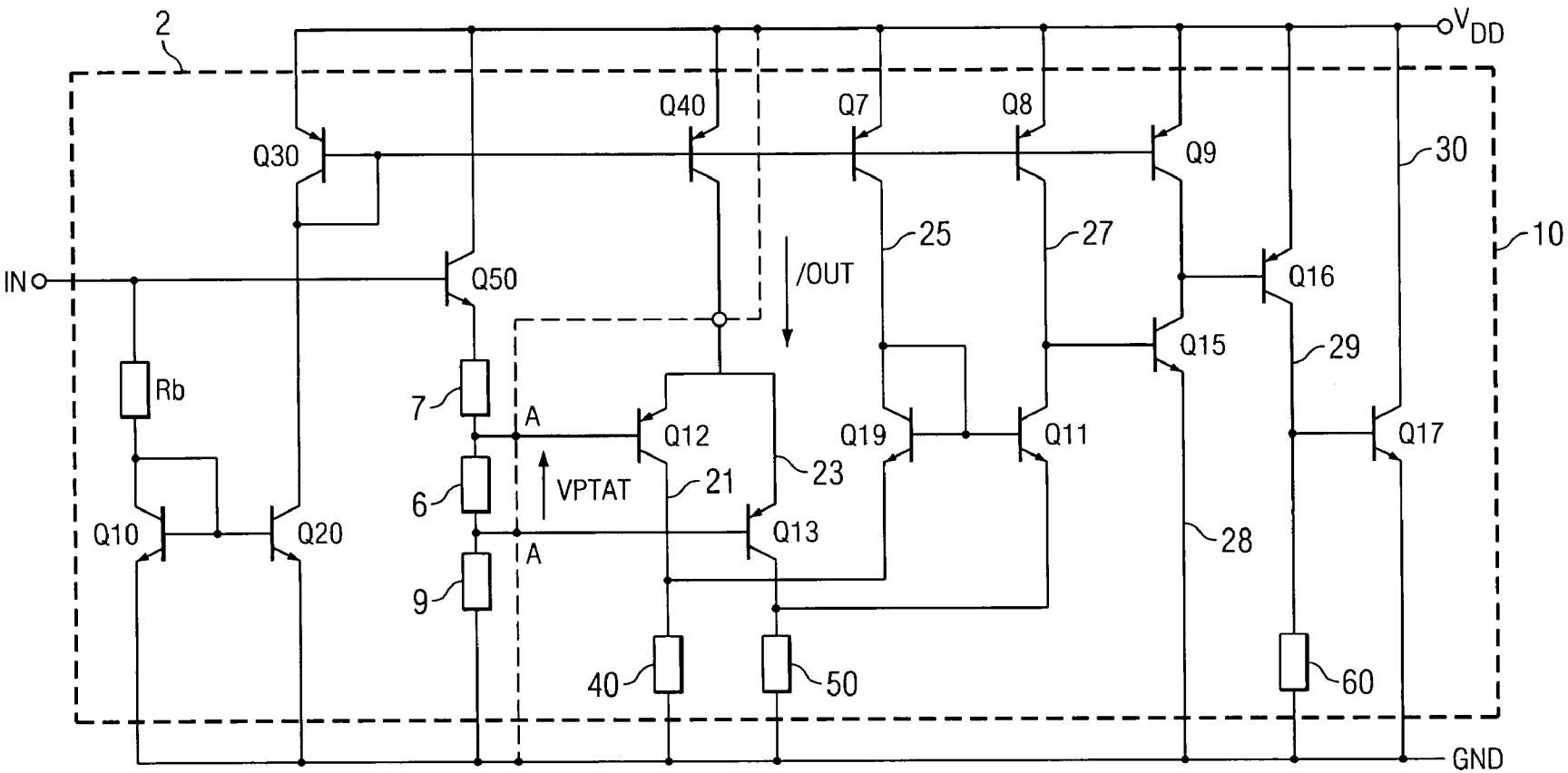
FIG. 4 shows the self-bias circuit connected to a PTAT generator according to an embodiment of the present invention.

FIGS. 2 through 4, discussed below, and the various embodiments used to describe the principles of the present invention in this patent document are by way of illustration only and should not be construed in any way to limit the scope of the invention. Those skilled in the art will understand that the principles of the present invention may be implemented in any suitably arranged circuit or system using a self-biased circuit.

FIG. 2 shows a self-biased circuit according to a preferred embodiment of the invention. An input terminal (IN) is connected to the base of a first transistor Q50. The collector of the first transistor Q50 is connected to the supply voltage VDD. The emitter of the first transistor Q50 is connected to ground GND through at least one resistor 6, although as shown in FIG. 2 a plurality of resistors (6,7,9) can be connected in series between the emitter of the first transistor Q50 and ground GND.

A first branch 13 is connected between the input terminal IN and ground GND, wherein the first branch comprises a second transistor Q10 having its collector connected to its base and also having its collector connected to one end of a first branch resistor Rb. The other end of the first branch resistor Rb is connected to the input terminal IN. The emitter of the second transistor Q10 is connected to ground GND. The base of the second transistor Q10 is also connected to a third transistor Q20 in a second branch 14. The first and second branches are arranged in parallel. The second and third transistors Q10 and Q20 form a first current mirror. The emitter of the third transistor Q20 is connected to ground GND and the collector of that transistor is connected to the collector of a fourth transistor Q30. The collector of the fourth transistor Q30 is also connected to its base. The emitter of the fourth transistor Q30 is connected to the voltage supply VDD.

The base of the fourth transistor Q30 is connected to the base of a fifth transistor Q40, which is located in a third branch 15, which is parallel to the first and second branches. The fifth transistor Q40 has its emitter connected to the voltage supply VDD and its collector supplies a current bias value $I_{OUT}$.

The current bias value Iout is used to bias a PTAT circuit 10, which generates an output voltage $V_{PTAT}$ across one of the resistors 6 connected to the emitter terminal of transistor Q50. The bias output may be in the form of a voltage or in any other suitable form.

According to a preferred embodiment the self-biased circuit 2 is shown to comprise the first to fifth bipolar transistors Q10, Q20, Q30, Q40 and Q50, which are capable of withstanding relatively high voltages. According to a preferred embodiment, the supply voltage VDD will be around 24V, which is easily withstood by bipolar transistors. In contrast, as explained above, a MOS transistor is only able to withstand up to around 14V across its gate and source terminal and is therefore not suitable for some embodiments of the present invention.

FIG. 3 shows an overview of the 3-pin self-biasing circuit 2 of the present invention. The self-biasing circuit 2 comprises three pins; an IN pin, a VDD pin, and a GND pin. The IN pin is connected to an external circuit 4, which is responsible for generating a low potential when the circuit is to enter a standby mode of operation as will be explained below.

It is now useful to discuss the two modes of operation of the self-biasing circuitry in relation to FIG. 2. During a normal mode of operation, the self-biasing circuitry 2 produces a bias value, which in the preferred embodiment is a current bias $I_{OUT}$, which biases PTAT circuitry 10. The PTAT circuitry 10 is responsible for producing a voltage $V_{PTAT}$ which is applied across the resistor 6 connected between the emitter terminal of the first transistor Q50 and ground (GND).

During the normal mode of operation, the input terminal (IN) is not affected by the voltage produced by external circuitry 4. Instead the reference voltage $V_{REF}$ which exists on the base of first transistor Q50 can be determined by applying a simple Kirchoff voltage law analysis to the circuit, in which it can be seen that the voltage applied to the base of first transistor Q50 (i.e. $V_{REF}$) is equal to the sum of the voltage drop across the base-emitter junction of the first transistor Q50 added to the voltage drops across the resistors 6, 7 and 9 connected between the emitter of Q50 and ground. The total voltage drop across the resistors is determined by the voltage $V_{PTAT}$ which is generated by the PTAT circuitry 10. That is, the voltage $V_{PTAT}$ is applied across one of the resistors 6, which will result in a current $I_{PTAT}$ being produced through resistor 6. Since the other resistors 7 and 9 are in series with resistor 6 the same current $I_{PTAT}$ will also flow through these resistors, which in turn will create further voltage drops across each resistor and therefore the total voltage drop across the emitter resistors can be scaled depending on the value of resistors 6, 7, 9 inserted into the emitter branch of Q50.

The value of the voltage at the input terminal of first transistor Q50 (i.e. $V_{ref}$) is therefore given by:

$$V_{ref}=V_{BE}(Q5)+K\times V_{PTAT}$$

where K is a constant.

In the preferred embodiment, the total voltage drop across the resistors will be scaled to be about 0.6V. For example, the value of the resistors 6, 7 and 9 are added and then divided by six to give a desired constant ratio for K. This volt drop is added to the forward biased voltage drop (which is also approximately 0.6V) across the base-emitter junction of Q50 ($V_{be}$), which will normally give a substantially constant $V_{ref}$ voltage of around 1.2V.

The bias output current $I_{out}$ is determined using the reference voltage $V_{ref}$, the resistance of the first branch resistor $R_b$ and the base-emitter voltage occurring across the transistor second Q10, i.e. $V_{BE}$(Q10), and this is given by the equation:

$$I_{out} = \frac{V_{ref} - V_{BE}(Q10)}{R_b}$$

It can be seen from FIG. 2, that the value of current flowing through the first branch resistor $R_b$ will be dependent on: the value of the resistance $R_b$, the value of reference voltage $V_{ref}$ and the forward voltage drop $V_{be}$ across the second transistor Q10 (since there is a direct connection between the base and collector terminals of second transistor Q10).

The third transistor Q20 has its base terminal connected to the base of the second transistor Q10, which combine to form a first current mirror. The first current mirror allows the current produced in the first branch 13 to be reflected in the second branch 14, which contains the switching terminals of third transistor Q20. FIG. 2 also shows a second current mirror formed by the fourth and fifth transistors Q30, Q40 being connected so as to produce the determined current bias value $I_{out}$. However, in an alternative embodiment, the second current mirror is not needed and the determined output bias value $I_{out}$ is produced directly in the second branch 14.

The generated current bias value $I_{out}$ is then used to bias a PTAT circuit 10. FIG. 4 shows a complete embodiment of the self-biasing circuit 2 and an example of a PTAT circuit 10. The point of the PTAT circuit is to generate a voltage $V_{PTAT}$, which is proportional to the absolute temperature. This allows the temperature variations of the self-biased circuit to be taken into account. That is, the transistor Q50 has a negative temperature coefficient and therefore as temperature increases the $V_{BE}$ of transistor Q50 decreases. However, the PTAT circuit 10 is used to take into account these temperature fluctuations and therefore as temperature increases so does the generated voltage $V_{PTAT}$, which results in $V_{ref}$ being kept at a substantially constant voltage and mitigates the effects of temperature fluctuations. That is in the preferred embodiment, $V_{ref}$ is maintained at a substantially constant 1.2V during the normal mode of operation of the biased circuit.

To enter a standby mode of operation, the IN terminal is connected to the external circuitry 4, which is arranged to take $V_{ref}$ to a low potential and thereby switch transistor the first transistor Q50 off. Also, by taking $V_{ref}$ to a low potential the self-bias circuit does not generate a bias current value, i.e. $I_{out}$=zero amps. It should be appreciated that in the preferred embodiment, the low potential will be ground.

The external circuitry 4 for supplying a ground potential to the IN terminal is not shown since there are many known circuits which can be used to achieve this effect, and which is beyond the scope of the present invention.

The PTAT circuitry 10 shown in the embodiment of FIG. 4 comprises the output bias current $I_{OUT}$ from circuit 2 being split into a fourth and fifth parallel branches 21, 23. The fourth branch 21 comprises a sixth transistor Q12 and a resistor 40. One end of the resistor is connected to ground, whereas the other end is connected to the collector of the sixth transistor Q12. The emitter of the sixth transistor Q12 is connected to receive the output bias current $I_{OUT}$ from circuit 2. The fifth branch 23 comprises a seventh transistor Q13 and a resistor 50. One end of the resistor 50 is connected to ground, whereas the other end is connected to the collector of the seventh transistor Q13. The emitter of the seventh transistor Q13 is connected to receive the output bias current $I_{OUT}$ from circuit 2.

The bases of the sixth and seventh transistors Q12 and Q13 are connected across the resistor 6 at terminals AA of self-biasing circuit 2 and provide the output voltage $V_{PTAT}$ from the PTAT circuitry 10.

The collectors of the sixth and seventh transistors Q12 and Q13 are also connected to the emitters of an eighth and a ninth transistor Q19, Q11 respectively. The eighth transistor forming part of a sixth branch 25, which also comprises a tenth transistor Q7. The tenth transistor having its emitter terminal connected to the voltage supply (VDD) and its collector connected to the collector of the eighth transistor Q19. The collectors are also connected to the base of the eighth transistor Q19.

The base of the eighth transistor Q19 is connected to the base of the ninth transistor Q11. The ninth transistor forming part of a seventh branch 27, which also comprises an eleventh transistor Q8 having its emitter connected to the voltage supply (VDD) and its collector connected to the collector of the ninth transistor Q11.

The collectors of the ninth and eleventh transistors are also connected to the base of a twelfth transistor Q15 occurring in an eighth branch 28. The eighth branch 28 also comprises a thirteenth transistor Q9 having its emitter connected to the voltage supply (VDD) and its collector connected to the connector of the twelfth transistor Q15.

The collectors of the twelfth and thirteenth transistors are also connected to the base of a fourteenth transistor Q16 occurring in a ninth branch 29. The emitter of the fourteenth transistor is connected to the supply voltage (VDD) and the collector is connected to one end of a resistor 60. The other end of the resistor 60 is connected to ground (GND).

The collector of the fourteenth transistor Q16 is also connected to the base of a fifteenth transistor Q17 in a tenth branch 30. The collector of the fifteenth transistor Q17 is connected to the supply voltage (VDD) and the emitter is connected to ground (GND).

The bases of transistors Q7, Q8, and Q9 are all connected together and also are connected to the bases of transistors Q30 and Q40.

Therefore, in summary it should be appreciated that during the normal mode of operation the $V_{ref}$ is maintained on the input terminal at a substantially constant value of around 1.2V, whereas during a standby mode of operation the input terminal is connected to ground and therefore $V_{ref}$ is zero volts and $I_{out}$ is zero amps.

The circuit 2 has been termed a so-called "self-biased" circuit in that the bias current $I_{out}$ is used to bias a PTAT circuit 10, which in turn generates a voltage $V_{PTAT}$ which is used to determine the reference voltage $V_{ref}$ on the IN terminal during normal operation.

It has also been taken into account that the generated bias value $I_{OUT}$ is also affected by the changes in the base-emitter voltage across the second transistor Q10, which is dependant on temperature fluctuations. Therefore, in another embodiment the first branch resistor $R_b$ can be thought of as comprising a plurality of resistors $Rb_1$-$Rb_n$, wherein some of the resistors are of a first type having a positive temperature coefficient, whereas the other resistors are of a second type having a negative temperature coefficient. These first and second types of resistors could for example be a combination of so-called "implanted" and "Poly" resistors. By scaling the number of the respective first and second types of resistors to form the total resistance value $R_b$, the negative temperature coefficient of $V_{BE}$ of the second transistor Q10 can be cancelled. Therefore, the self-biasing circuit effectively biases itself with a near constant current.

It should be appreciated that the input pin (IN) of the self-biasing circuit performs two functions. Firstly it is used to program the output current bias value generated by the self-biased circuit during a normal mode of operation and secondly it is used to put the self-biased circuit into a standby mode of operation when taken to a low potential. That is, when the voltage reference $V_{ref}$ is taken to a low potential two things occur, i) the first transistor Q50 switches off since the base-emitter junction $V_{be}$ is no longer forward biased, and ii) the current produced in the first branch 13 is negligible since there is no longer a potential difference occurring across the first branch resistor $R_b$. This negligible current is reflected in the second branch 14 via the first current mirror (the second and third transistors Q10, Q20) and also in the second current mirror (the fourth and fifth transistors Q30, Q40), which results in the current bias value being substantially zero amps in the standby mode, i.e. the self-bias circuit 2 is switched off and no bias value is produced.

It should be appreciated that in alternative embodiments of the present invention, the VPTAT generator can be replaced by other circuitry such as an amplifier, etc. This circuitry should be able to provide an output voltage or current which is responsive to the input current or voltage provided to it.

It should be appreciated that although FIG. 2 is a preferred embodiment, other embodiment may also exist, in which for example the polarity of the transistors can be reversed and their connections to the supply rails. That is, FIG. 2 shows the transistors Q10, Q20 and Q50 being NPN transistors, whereas the transistors Q30 and Q40 are PNP transistors, however these transistors can be interchanged provided the polarity of the circuit (i.e. connections to VDD and GND) are also interchanged.

Also, the transistors Q10, Q20, Q30, Q40 and Q50 are shown as being BJT transistors, however these could be swapped with any other switching devices capable of withstanding the relatively high voltages of the process of the present invention or the required application of the particular embodiment of the invention. Thus for some applications of embodiments of the invention FETs can be used. It is intended that the present invention encompass changes and modifications as fall within the scope of the appended claims.

What is claimed is:

1. A biasing circuit comprising:

first circuitry having an output for providing an input to second circuitry and a first input of the first circuitry for receiving an output from said second circuitry, said output of said second circuitry being responsive to said output of said first circuitry, said first circuitry being arranged to provide at a terminal a reference at a substantially constant value for controlling the input to the second circuitry, said first circuitry being responsive to the output from said second circuitry when providing said reference in a normal mode, wherein said circuit further has a standby mode in which a second input to the first circuitry provides at said terminal a reference at a low value;

wherein a voltage is provided on the second input of the first circuitry when in the normal mode;

wherein the second input is a control terminal for a first switching device having first and second switching terminals, the first switching terminal being connected to a second voltage and the second switching terminal being connected through a first resistance to a third voltage; and wherein the first circuitry comprises a first branch connected between the control terminal and the third voltage, the first branch having a second resistance and a second switching device, and wherein the second switching device forms a first current mirror with a second branch providing the output to the input of the second circuitry.

2. The biasing circuit of claim 1, wherein said reference comprises a reference voltage.

3. The biasing circuit of claim 1, wherein for the standby mode the second input provides an input which causes the output of the first circuitry to provide no output.

4. The biasing circuit of claim 3, wherein the first circuitry is arranged to set the reference to said input provided by the second input.

5. The circuit according to claim 1, wherein the output is a current determined by subtracting a voltage occurring across a control terminal and a switching terminal connected to the third voltage of the second switching device from the reference voltage, and dividing a result by a value of the second resistance.

6. The biasing circuit of claim 1, wherein the reference is a voltage equal to a voltage generated across the first resistance added to a voltage occurring across the control terminal and the second switching terminal of the first switching device.

7. The biasing circuit of claim 1, wherein the switching devices are bipolar transistors.

8. The biasing circuit of claim 1, wherein the second resistance comprises a plurality of resistors, at least one of which has a positive temperature coefficient and at least one of which has a negative temperature coefficient.

9. The biasing circuit of claim 1, wherein the second circuitry comprises one of a proportional to absolute temperature circuit and an amplifier circuit.

10. An integrated circuit comprising a biasing circuit as set forth in claim 1.

11. The biasing circuit of claim 1, wherein the reference at the low value is ground.

12. A biasing circuit comprising:

first circuitry having an output for providing an input to second circuitry and an input of the first circuitry for receiving an output from the second circuitry, the output of the second circuitry being responsive to the output of the first circuitry, the first circuitry being arranged to provide a reference for controlling the input to the second circuitry, the first circuitry being responsive to the output from the second circuitry when providing the reference;

wherein a voltage is provided on a second input of the first circuitry when the first circuitry provides the reference, the second input comprising a control terminal for a switching device having first and second switching terminals, the first switching terminal being connected to a second voltage and the second switching terminal being connected through a first resistance to a third voltage; and wherein the first resistance comprises a plurality of resistors, and wherein the output of the second circuitry is an output voltage which is provided across at least one of the resistors to produce a current through said resistors, causing a total voltage drop across the first resistance to be scaled by a factor of k times the output voltage.

13. The biasing circuit of claim 12, wherein the output voltage provided by the second circuitry is proportional to an absolute temperature.

14. The biasing circuit of claim 13, wherein the switching device has a negative temperature coefficient so that as temperature increases a voltage occurring across the control terminal and second switching terminal decreases, and the output voltage output from the second circuitry increases to compensate for temperature.

15. A biasing circuit comprising:

first circuitry having an output for providing an input to second circuitry and an input of the first circuitry for receiving an output from the second circuitry, the output of the second circuitry being responsive to the output of the first circuitry, the first circuitry being arranged to provide a reference for controlling the input to the second circuitry, the first circuitry being responsive to the output from the second circuitry when providing the reference;

wherein a voltage is provided on a second input of the first circuitry when the first circuitry provides the reference, the second input comprising a control terminal for a switching device having first and second switching terminals, the first switching terminal being connected to a second voltage and the second switching terminal being connected through a first resistance to a third voltage;

wherein the first circuitry comprises a first branch having a second resistance and a second switching device, the second resistance comprising a plurality of resistors, at least one of which has a positive temperature coefficient and at least one of which has a negative temperature coefficient, and wherein the resistors are arranged to compensate for a negative temperature coefficient of the second switching device, thereby generating a substantially constant output to the input of the second circuitry.

* * * * *